United States Patent [19]

Darnell

[11] 4,230,090

[45] Oct. 28, 1980

[54] HEATING STOVE

[76] Inventor: Eric Darnell, South Strafford, Vt. 05070

[21] Appl. No.: 901,582

[22] Filed: May 1, 1978

[51] Int. Cl.[3] ..... F24B 7/00

[52] U.S. Cl. ..... 126/72

[58] Field of Search ..... 126/72, 67, 90 R, 61, 126/63

[56] References Cited

U.S. PATENT DOCUMENTS

| | | | |
|---|---|---|---|
| 406,955 | 7/1889 | Rider | 126/72 |
| 610,795 | 9/1898 | Bowers | 126/72 |
| 1,707,096 | 3/1929 | Rich | 126/72 |
| 2,475,120 | 7/1949 | Young | 126/72 |
| 4,127,100 | 11/1978 | Baker | 126/72 |

*Primary Examiner*—Samuel Scott
*Assistant Examiner*—Wesley S. Ratliff, Jr.
*Attorney, Agent, or Firm*—Charles N. Quinn

[57] ABSTRACT

A heating stove has a fire box composed of first and second pluralities of parallel aligned connected vertically oriented curved open-ended conduits lower extremities of the conduits of said first and second pluralities being aligned for contacting a common planar surface to support the stove, with the fire box further being formed by generally planar front and back plates, of substantially the same size and shape, with the front plate having an inlet port therethrough and the back plate having an exhaust port therein. The conduit central portions are largely within the stove fire box. A baffle within the fire box promotes three-pass flow of hot air across the conduit surfaces within the fire box. The first and second pluralities of curved conduits are opposed and in interdigitated engagement. Curved strips separate the curved conduits and thus facilitate stove construction with the conduits in interdigitated engagement. A closing mechanism for the stove door operates with caming action to assure that the door, when closed, is tightly fastened so that the hot coals cannot escape. In another embodiment, the fire box is cylindrical, formed by two curved side plates and two generally planar end plates, and the curved conduits pass through the fire box.

11 Claims, 6 Drawing Figures

HEATING STOVE

BACKGROUND OF THE INVENTION

1. Field of the Invention

This invention relates to stoves used for heating.

2. Description of the Prior Art

Stoves used to heat interior space by burning fuels such as wood and coal are known and are disclosed in U.S. Pat. Nos. 98,882; 195,511; 646,853; 1,116,674, 1,640,771; 1,728,241; 1,866,427 and 2,058,094. U.S. Pat. No. 1,116,674 discloses a stove made in two sections, a flat inner section and a convoluted outer section. Use of the two sections allows formation of a passageway which air flows through, where the air is heated. The heated air is exhausted vertically out the top of the stove. U.S. Pat. No. 1,640,771 discloses a grate for use in a home fireplace. The 2,058,094 patent discloses a stove which utilizes a duct which in part passes around the periphery of a heating stove and allows passage therethrough of air to be heated. The 1,866,427, 1,728,241, 646,853, 195,511 patents disclose stoves in which the exhaust gas can either be fed directly to the exhaust flue or diverted within the stove to allow more heat to be extracted from the exhaust gas. None of the stoves disclosed in these patents provide any substantial means for conveying the heat generated in the stove fire box into the space for which the stove is to provide heat.

Other stove configurations are shown in the articles "Wood As Fuel" appearing in the October, 1976 issue of *Popular Science,* "Woodburning" appearing in the October, 1976 issue of *Blair & Ketchum's Country Journal,* and in the publications *Woodburner's Encyclopedia* and the *Wood Stove Directory,* published in September of 1977. A general discussion of some problems in wood burning stove design appears in the paper "Progress Report on Wood Stove Testing and Design Study" presented at the New England Conference on Energy in Agriculture, which was held May 3 and 4, 1976. The stoves disclosed in these references do not disclose effective means for conveying heat generated in the stove fire boxes into the space sought to be heated by the stove.

SUMMARY OF THE INVENTION

This invention provides a heating stove having a fire box which includes first and second pluralities of parallel aligned connected vertically oriented curved open-ended conduits, with the ends of the conduits of the first and second pluralities being in interdigitated engagement. Planar front and back plates have inlet and exhaust ports therethrough for passage of air into the fire box and for passage of exhaust gas and smoke out of the fire box. The configuration of the conduits allows entry of cool air into the conduits at floor level and exit of the air, after being heated, in a horizontal direction, to efficiently heat the space in which the stove is located. A generally planar baffle in the upper portion of the fire box interior provides for three-pass flow of heated exhaust air within the fire box, before the heated air is exhausted, to thereby convectively heat the central portions of the first and second pluralities of conduits. In another embodiment, the fire box is formed by two curved side plates and two generally planar end plates, and curved conduits pass through the fire box.

DESCRIPTION OF THE PREFERRED EMBODIMENTS

Figure 1:
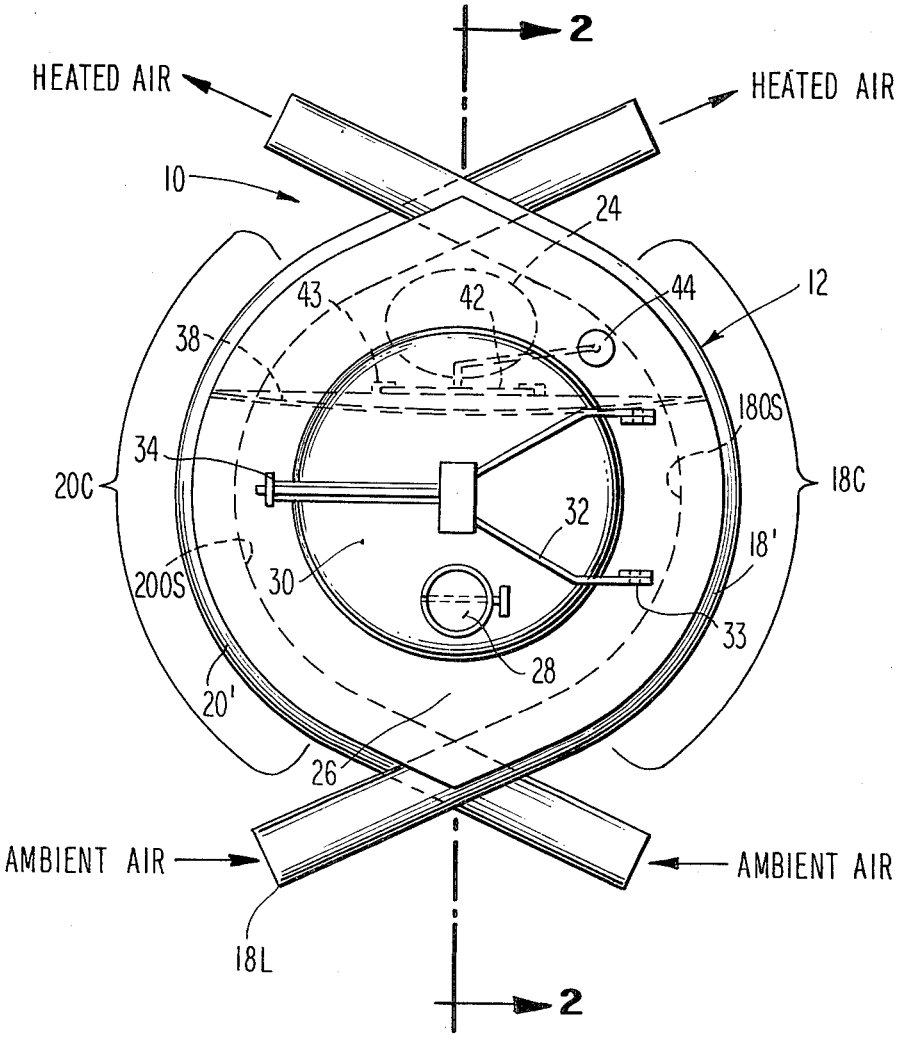
FIG. 1 is a front elevation view of a stove embodying the invention.
Figure 2:
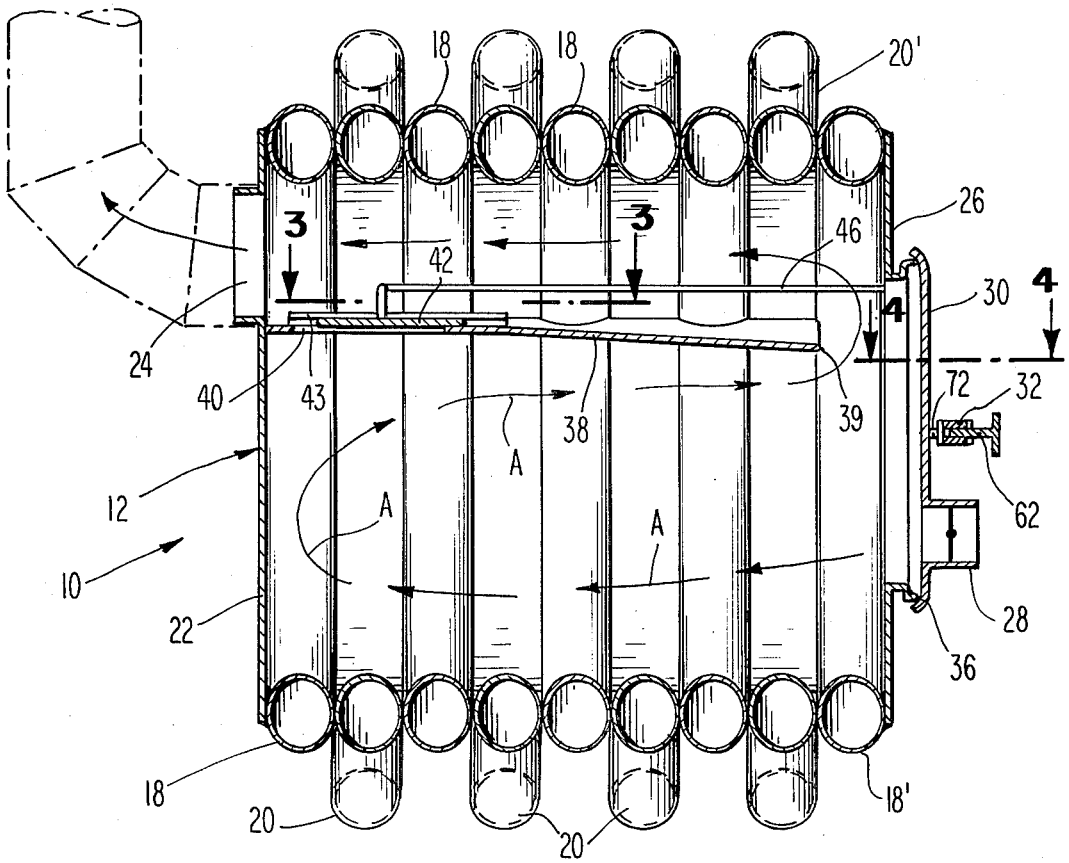
FIG. 2 is a side sectional view of a stove embodying the invention, taken at arrows 2—2 in FIG. 1.

Referring to FIG. 1, which illustrates a first embodiment a stove manifesting the invention, the stove is designated generally 10 and includes a fire box or chamber designated generally 12. The fire box is formed by first and second pluralities of parallel aligned connected vertically oriented curved open-ended conduits; only the first conduits of said first and second pluralities are visible in FIG. 1, said first conduits of said first and second pluralities being respectively designated 18' and 20'. Each plurality of curved open-ended conduits, wherein the conduits of said first plurality are designated 18 and the conduits of said second plurality are designated 20, consists of aligned, parallel open-ended conduits with each plurality having the lower extremities of the conduits aligned to contact a planar surface and thereby support the stove. The parallel lower ends of the first plurality of conduits are designated 18L in FIG. 2. Preferably, both the first and second pluralities of conduits are composed of identical conduits, with the second plurality positioned to generally oppose the first plurality and with the ends of the individual conduits of said first and second pluralities being in alternating interdigitated engagement with each other, as best shown in FIG. 2. The first and second pluralities of conduits form the first and second sides of the fire box or chamber 12. Also comprising the fire box 12 are a preferably generally planar back plate 22 having an exhaust port 24 therethrough and forming the rear portion of the fire box, and a preferably generally planar front plate 26 having a door 30 therein with an inlet port 28 therethrough. The front and back plates are preferably of substantially the same size and shape. In the embodiment shown, as best illustrated in FIG. 2, the most forward positioned conduits (right-most as viewed in FIG. 2) of said first and second pluralities are preferably connected, preferably via welding, to front plate 26 about the periphery thereof while the most rearward positioned conduits (left-most as viewed in FIG. 2) of said first and second pluralities are preferably connected, preferably by welding, to rear plate 22 about the periphery thereof.

Within door 30 is a valve 28, preferably of the butterfly type, which functions as means for regulating the flow of air into fire box 12. Door 30 in front plate 26 is provided, movable on hinges 33, for access to the fire box, when the fuel therein must be replenished. Door 30 is secured at a central portion thereof to linkage 32 which is received by latch 34 when it is desired to rigidly secure door 30 about the margin of opening 36 in front plate 26. When fuel is required, an operator merely unlatches latch 34 and moves door 30 away from opening 36, to allow access to the interior of the fire box. The latching mechanism is described in more detail below.

As indicated by the legends "Ambient Air" and "Heated Air" in FIG. 1, when the stove is operating with a fire burning within the fire box, ambient, preferably cool, air enters the pipes of pluralities 18 and 20 at the lower ends thereof, from the region proximate the bottom of the space in which stove 10 is located. Due to fire within the fire box, the curved central portions of the conduits of pluralities 18 and 20, designated by brackets 18C and 20C, become hot since the convex outer surfaces 180S and 200S of the curved conduits bound the fire as the conduits form the curved lateral surface of the fire box. The resulting temperature difference, with the conduit central portions 18C and 20C of the conduits being substantially warmer than the lower extremities of the conduits, causes the air within the conduits to naturally convect upwardly with the warmed air, being of lower density, rising through the outlet marked "Heated Air" and the cooler air rising to fill the void within the conduit created when the warmed air rises and leaves the conduit.

During stove operation, conduit lower portions remain at ambient temperature while the conduit central portions and the conduit outlet ends become quite warm. Thus, a substantial temperature gradient exists along the length of the conduits. The temperature gradient creates a substantial air flow through the conduits with the heated air exiting in the direction shown, flowing in a direction closer to horizontal than to vertical. This creates air circulation in the space in which the stove is located and effectively warms the space in a substantially uniform fashion.

An exhaust port 24 is provided at the upper portion of rear plate 22; typically an exhaust conduit is provided which provides stove exhaust to the outdoors, preferably via connection of the exhaust conduit to a suitable chimney.

The exhaust port is located above a baffle plate 38 which extends transversely across the width of the fire box interior and which extends forward from the stove rear plate to form a lip 39 at a position which is preferably closer to front plate 26 than to rear plate 22. This is best shown in FIG. 2.

Referring to FIG. 2, the aligned parallel configuration of the two pluralities of conduits is clearly evident. Each of the conduits is preferably identical to the remaining conduits. The central portion of each conduit is curved to such a degree so that when the conduit is upright, as shown in FIGS. 1 and 2, the conduit ends extend in directions which are closer to horizontal than to vertical. This configuration facilities air circulation throughout the space which is being heated.

In the embodiment illustrated, the number of conduits 18 in the first plurality exceeds the number of conduits 20 in the second plurality by one; that is, there are illustrated five conduits 18 as belonging to the first plurality and four conduits 20 as belonging to the second plurality. The stove may also be constructed with the number of conduits in said first and second pluralities equal.

Within baffle plate 38, at a position proximate the rear plate 22, there may be provided a bypass port 40 covered by a moveable planar damper 42. Damper 42 may be slideably resident within two tracks 43, formed of angle stock and secured to baffle plate 38. A handle 44, best shown in FIG. 1, may be provided connected to damper 42 via rod 46 and can be used to move damper 42 in the direction shown by arrow B in FIG. 3 to thereby open or close bypass port 40. When a fire is being started in the stove, bypass port 40 can be opened and valve means 28, if not door 30, can be opened to provide draft through the stove. Once the fire has been sufficiently started, door 30 is closed, bypass port 40 is closed and valve 28 is adjusted to provide the desired rate of burn of the fuel within the stove.

Whether or not a bypass is provided, baffle plate 38 causes an "S-shaped" pattern of hot air flow within the fire box, as indicated by the arrows A in FIG. 2. This pattern of air flow assures that a maximum convex area of conduit wall is exposed to the hot air within the fire box and hence that heat transfer from the stove to the surrounding space is maximized. The S-shaped pattern of flow also results in the hot air having a maximum residence time in the stove fire box; this assures relatively complete combustion of the fuel and minimizes problems of creosote build-up in the pipe connecting the exhaust port to the chimney and in the chimney proper.

Figure 3:
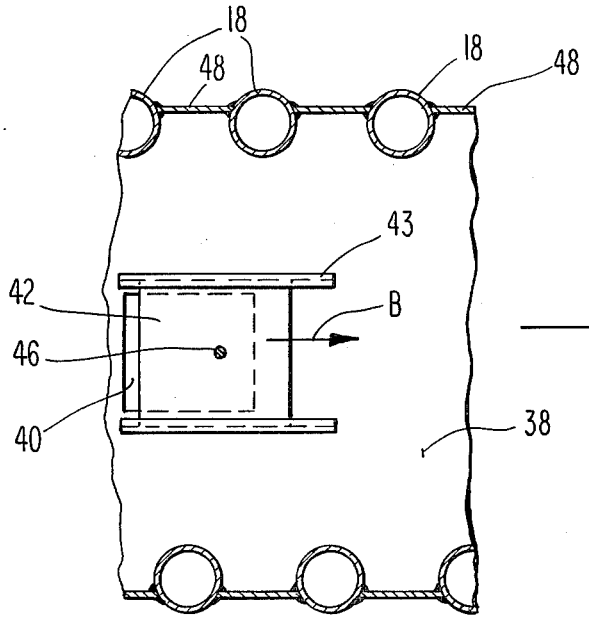
FIG. 3 is a broken sectional view of a portion of another embodiment of a stove manifesting the invention, taken at arrows 3—3 in FIG. 2.

Referring to FIG. 3, it is seen that between adjacent conduits there may be provided curved strip members 48, with each strip 48 secured to and disposed between two adjacent conduits of one of the pluralities of conduits. The strips and conduits in combination thereby form the two opposed curved surfaces of the stove fire box with each curved surface having conduits and strips disposed in a conduit-strip-conduit-strip-conduit fashion. Strips which are interposed between conduits of said first plurality abut, and are preferably welded to, the conduit of the second plurality which faces that strip. The strips abut their respective facing conduits at the strips ends; the weld joints are located at the strip ends and are along section line 2—2 viewed in FIG. 1. Each strip is also preferably welded, along its entire margin, to the conduits on both lateral sides thereof, so that the strips and conduits form a solid, airtight generally cylindrical wall of the stove fire box. End strips are welded on one margin to the respective front or back plate. Strips interposed between conduits of said second plurality are treated similarly. In this connection it is to be understood that when the expressions "cylindrical" and "circularly" and variations thereof, are used in this application, they denote a shape as defined by the periphery of front plate 26 as viewed in FIG. 1; as used herein these expressions do not denote only those shapes which are defined by a continuous curve all points on which are a constant distance from a designated center.

Figure 4:
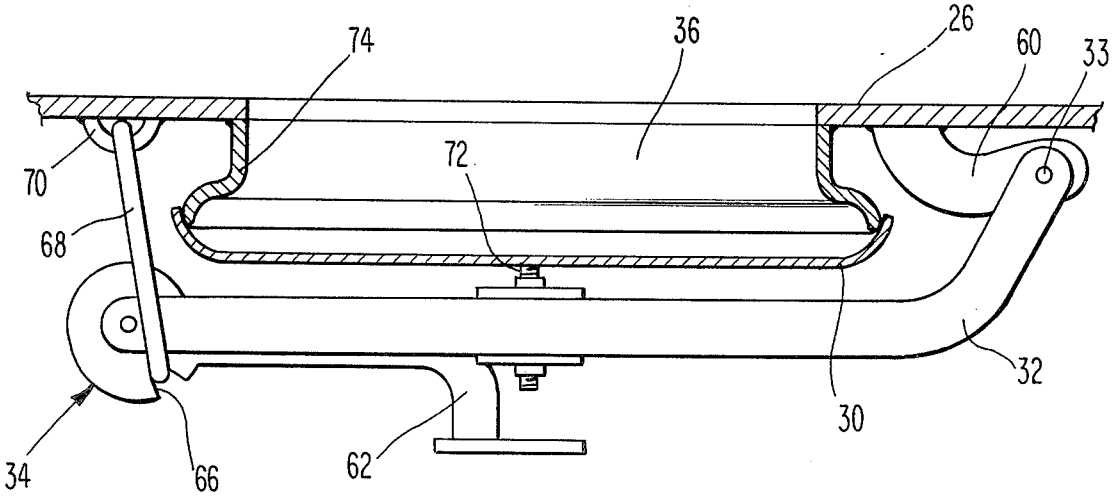
FIG. 4 is a partial sectional view taken at arrows 4—4 in FIG. 1.

Referring to FIG. 4, the latching mechanism for door 30 includes a linkage arm 32 which pivots at hinges 33 which are secured to plate members 60 which extend from front plate 26 outboard of opening 36 therein. A handle 62 is pivotally mounted at the end of linkage arm 32 remote from hinge 33. Formed at the end of handle 62, at the point of pivotal connection to linkage arm 32, is a horizontal cam 64 with a notch 66 formed therein at a position proximate the major diameter of the cam. A link 68 having an open center is pivotally connected to front plate 26 by eye 70 Linkage arm 32 is connected to the center of door 30, which is preferably of circular shape, by a suitable bolt or other securing means 72. Door 30 contacts rim 74 about its entire periphery, when the door is in the position shown in FIG. 4, and tightly closes the opening 36 so that air cannot enter or leave the fire box at the line of contact of door 30 with rim 74. When the door is in the open position and it is desired to close the door, handle 62 is rotated, thereby rotating cam 64, until link 68 can be engaged into notch 66. Once the link is so engaged, handle 62 is rotated counterclockwise, as viewed in FIG. 4, whereupon the interaction of the cam 64 with link 68 forces door 30 tightly against rim 74. The cam and link are dimensioned so that notch 66 is to the right of the cam pivot point, closer to door 30, when the door abuts rim 74, as shown in FIG. 4. Since linkage arm 32 applies the force to close door 30 at the door center and since the door periphery is circular, the door-rim closure is warp-resistant.

Figure 6:
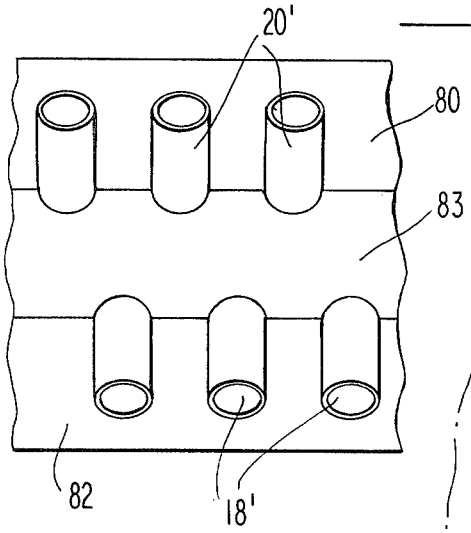
FIG. 6 is a broken top view of a stove, of the embodiment illustrated in FIG. 5, manifesting the invention.
Figure 5:
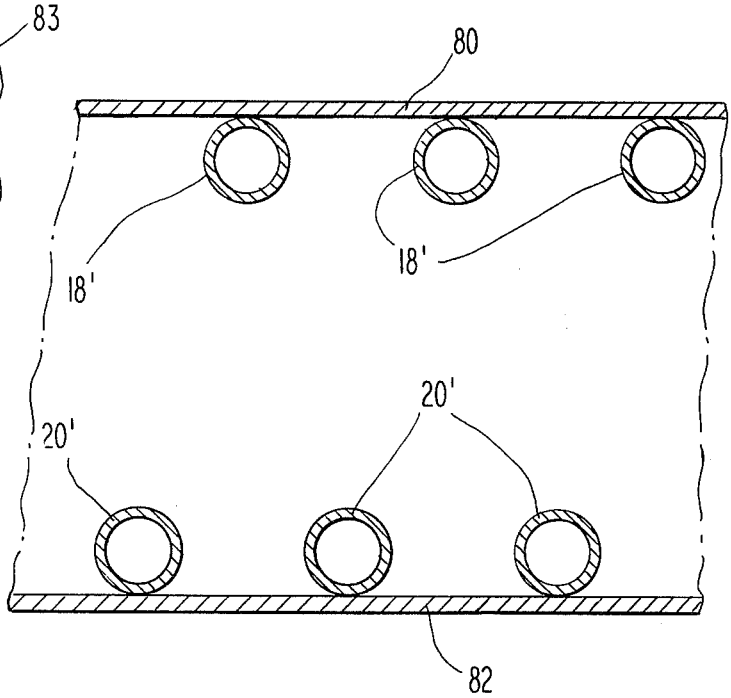
FIG. 5 is a broken sectional view of a portion of yet another embodiment of a stove manifesting the invention, also taken at arrows 3—3 in FIG. 2.

Referring to FIGS. 5 and 6, there is shown another embodiment of a stove manifesting the invention. In this embodiment, the other periphery of the fire box is defined by front and rear plates, which are substantially as depicted in FIGS. 1 and 2, by first and second longitudinally extending opposed curved plates designated 80 and 82 in FIGS. 5 and 6 and by curved top and bottom mating plates which connect together the horizontally extending top and bottom margins of curved plates 80 and 82; the top mating plate is designated 83 in FIG. 6. The horizontally extending top and bottom margins of curved plates 80 and 82 have a plurality of generally semi-circular cutouts therein. The longitudinal margins of the top and bottom mating plates similarly have semicircular cutouts, which are positioned opposing corresponding cutouts in the curved plates 80 and 82. Together the corresponding opposed pairs of cutouts in the curved plates and the mating plates form a plurality of orifices through which the conduits of said first and second pluralities pass, one conduit per orifice, to enter and exit the generally cylindrical fire box. The conduits are welded to the curved plates 80 and 82 and to the top and bottom mating plates at the position where the conduits enter and exit the fire box. The top and bottom mating plates are welded to curved plates 80 and 82 about the peripheries of the mating plates. The curved plates may also be welded to the convex exterior surfaces of the conduits, as illustrated in FIG. 5. The number of cutouts in the first curved plate upper edge differs from the number of cutouts in the second curved plate upper edge by at most one, so that the alternate conduits, of the first and second pluralities, which pass through the orifices formed by the cutouts, can be adjacent to one another. The cutouts in the first curved plate longitudinally extending lower edge are parallel to and aligned with the cutouts in the first curved plate longitudinally extending upper edge. The cutouts in the second curved plate upper and lower edges are aligned similarly. To facilitate this arrangement of the conduits, the cutouts in the first plate are longitudinally positioned to correspond to the regions between adjacent cutouts in the second plate, and vice versa. The semicircular cutouts in the longitudinally extending edges of the top and bottom curved plates are positioned alternately, for complemental mating with corresponding cutouts in the edges of the first and second longitudinally extending opposed curved plates, to form the circular openings through which the conduits pass. The first and second pluralities of conduits in effect pass through plates 80 and 82, entering the fire box at the plate horizontally extending lower edges and leaving the fire box at the plate horizontally extending upper edges. Welds at the curved plate upper and lower horizontally extending edges effectively seal the fire box at the position where the conduits enter and leave the fire box. A baffle, valve and door are all preferably provided of the type described above. The lower extremities of the individual conduits of the first and second pluralities are parallel to contact a planar surface, to support the stove. All of the conduits are preferably identical; conduits of the first plurality are designated 18' in FIGS. 5 and 6 while conduits of the second plurality are designated 20' in FIGS. 5 and 6. The conduits have open ends and the conduit extremities preferably extend in a direction closer to horizontal than to vertical when the stove is assembled.

The components from which the stove is fabricated, that is, the conduits, the front and back plates, the door, hinges, baffle plate and strips, may be provided as a series of modular components from which the purchaser may select a particular combination so as to fabricate a stove, manifesting the invention, of size and heating capacity selected by the purchaser. In such event the purchaser buys his selected number of conduits and then arranges them in two groups, to form the first and second pluralities, with the number of conduits in the two groups differing by at most one. He then proceeds to assemble the stove, preferably by welding the components together as required.

When the stove of the invention has been constructed and operated, it has been found to effectively convect heat throughout the space sought to be heated. The baffle and valve means, and resulting S-shaped flow, have been found to produce a slow, steady and even-burning fire; this maximizes the stove's fuel economy. The lower ends of the conduits are always cool while the middle and upper portions of the tubes convect so much heat that the chimney stays far cooler than with conventional stoves. Internal combustion is sufficiently efficient that creosote build-up in the exhaust pipe and chimney is minimized.

In one embodiment the stove has been constructed with the conduits formed of 0.083 inch thick steel pipes which have been cold rolled and mechanically welded. The conduits were 4 feet, 6 inches long before bending. The conduits were bend 17 degrees on 1 inch intervals with 11 inches at either end of each conduit left straight. The strips between the conduits have been one-eighth by three by thirty-six inch hot rolled flat stock. The stove had overall dimensions of 28 inches length, 22 inches width, 12 and ½ inches wide at the conduit extremities and 32 inches height. The baffle plate was 6 inches from the stove interior top. The front and rear plates were made of ¼ inch hot rolled plate steel. The conduits, strips and front and rear plates were secured together by welding.

Although the preferred embodiment has been described as the best mode currently contemplated for carrying out the invention, variations and combinations, including reversals of parts from those shown, are possible. The invention is to be measured according to the claims appended hereto.

I claim the following:

1. A heating stove comprising:

(a) a longitudinally extending generally cylindrical fire box including:

(i) a first plurality of parallel aligned connected vertically oriented curved uniform cross-section open-ended conduits, lower extremities of said conduits of said first plurality aligned for contacting a planar surface to thereby support said stove;

(ii) a second plurality of parallel aligned connected vertically oriented curved uniform cross-section open-ended conduits, lower extremities of said conduits of said second plurality aligned for contacting said planar surface to thereby support said stove;

said second plurality of conduits positioned opposing said first plurality of conduits and in alternating interdigitated engagement therewith at intermediate upper and lower positions on said conduits, said positions defining upper and lower extremities of said fire box; said first and second pluralities of conduits being disposed symmetrically about a longitudinal axis of said cylindrical fire box;

major curved central portions of said first and second pluralities respectively being spaced from and facing one another and curved about said longitudinal axis with curved central portions of each plurality defining a curved half of said generally cylindrical fire box;

outwardly facing surfaces of said conduits of said first and second pluralities defining a generally cylindrically configured curved exterior surface of said stove; extremities of said conduits extending tangentially outwardly away from said cylindrically configured fire box and defining upper and lower stove extremities; upper extremities of said conduits of said first and second pluralities being vertically aligned with their respective lower extremities;

(iii) a generally planar back plate having an exhaust port therethrough;

(iv) a generally planar front plate, of substantially the same size and shape as said back plate, including an operable door having an inlet port therethrough;

most forward positioned conduits of said first and second pluralities each connected to said front plate at the periphery thereof; most rearward positioned conduits of said first and second pluralities each connected to said back plate at the periphery thereof;

(b) a longitudinally extending generally planar baffle connected to at least some of said conduits of said first and second pluralities, and to said back plate below said exhaust port to contact said back plate across the interior width thereof, extending forward towards said front plate, within said fire box interior;

(c) valve means, in said door, for admitting air to said fire box.

2. The stove of claim 1 wherein said baffle slopes from said back plate to said front plate.

3. The stove of claim 1 wherein said baffle has a passageway therethrough proximate said back plate and wherein said stove further comprises a damper, moveable along said baffle, over the top surface thereof, between a first position where said damper blocks said passageway and a second position where said passageway is open.

4. The stove of claim 1 wherein said baffle is level and extends forward from said back plate towards said front plate 5. The stove of claim 1 wherein all of said conduits are identical.

6. The stove of claim 1 wherein extremities of said conduits extend in a directon closer to horizontal than to vertical.

7. The stove of claim 1 further comprising a plurality of curved strip members, each strip secured to and disposed between two adjacent conduits of one of said first and second pluralities of conduits, said first and second opposed curved surfaces of said fire box having strip members and conduits disposed in a conduit-strip-conduit-strip-conduit fashion.

8. A heating stove comprising:

(a) a longitudinally extending cylindrical fire box including:

(i) a generally planar circular back plate having an exhaust port therethrough;

(ii) a generally planar circular front plate, of substantially the same size and shape as said back plate, including an openable door having an inlet port therethrough;

(iii) first and second longitudinally extending opposed curved plates, said first and second curved plates secured at their vertically extending curved edges to the peripheries of said circular front and back plates, said first and second longitudinally extending opposed curved plates being diametrically separated from each other about said peripheries of said circular front and back plates, longitudinally extending edges of said first and second longitudinally extending opposed curved plates having semi-circular cutouts therein, each plate having corresponding vertically parallel cutouts in upper and lower longitudinally extending edges, the number of cutouts in said first curved plate upper edge differing from the number of cutouts in said second curved plate upper edge by at most one, adjacent cutouts in each plate being separated by at least the width of a cutout, said cutouts in said first plate being longitudinally positioned to correspond to the regions between adjacent cutouts in said second plate;

(iv) top and bottom longitudinally extending opposed curved mating plates, said top and bottom curved plates secured at their curved edges to the peripheries of said circular front and back plates and being interposed between and separating said first and second longitudinally extending curved plates around the peripheries of said circular front and back plates, longitudinally extending edges of said top and bottom curved plates having semicircular cutouts therein complementally mating with corresponding cutouts in said first and second longitudinally extending opposed curved plates to form circular openings, in the curved surface formed by said first and second longitudinally extending plates and said top and bottom curved plates of said cylindrical fire box, at the junctures of the longitudinally extending edges of said first and second and top and bottom curved plates;

(v) a first plurality of parallel aligned vertically oriented curved open-ended conduits, lower extremities of said conduits of said first plurality aligned for contacting a planar surface, to support said stove, a central portion of each conduit of said first plurality tangentially contacting and secured to a surface of said first curved plate which is interior said cylindrical fire box, each conduit of said first plurality passing through one of said openings between said bottom curved plate and said first curved plate and into said fire box interior, and each conduit of said first plurality passing through one of said openings between said top curved plate and said first curved plate out of said fire box;

(vi) a second plurality of parallel aligned vertically oriented curved open-ended conduits, lower extremities of said conduits of said second plurality aligned for contacting said planar surface, to support said stove in combination with said first plurality of conduits, a central porton of each conduit of said second plurality tangentially contacting and secured to a surface of said second curved plate which is interior and cylindrical fire box, each conduit of said second plurality passing through one of said openings between said bottom curved plate and said second curved plate and into said fire box interior, and each conduits of said second plurality passing through one of said openings between said top curved plate and said second curved plate and out of said fire box;

(b) a generally planar baffle connected to at least some of said conduits of said first and second pluralities, and to said back plate below said exhaust port, extending forward towards said front plate within said fire box interior; and (c) valve means, in said door, for admitting air to said fire box.

9. The stove of claim 8 wherein said baffle is level.

10. The stove of claim 8 wherein all of said conduits are identical.

11. The slove of claim 8 wherein extremities of said conduits extend in a direction closer to horizontal than to vertical.

* * * * *